US010586504B2

(12) United States Patent
Shin et al.

(10) Patent No.: US 10,586,504 B2
(45) Date of Patent: Mar. 10, 2020

(54) DISPLAY APPARATUS AND A METHOD OF DRIVING THE SAME

(71) Applicant: SAMSUNG DISPLAY CO., LTD., Yongin-si, Gyeonggi-Do (KR)

(72) Inventors: Seung-Woon Shin, Asan-si (KR); Jahun Koo, Asan-si (KR); Young-Il Kim, Asan-si (KR); Sung-Jae Park, Seongnam-si (KR); Sehwan An, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 294 days.

(21) Appl. No.: 15/448,937

(22) Filed: Mar. 3, 2017

(65) Prior Publication Data

US 2017/0309241 A1 Oct. 26, 2017

(30) Foreign Application Priority Data

Apr. 20, 2016 (KR) ..... 10-2016-0048084

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2300/043* (2013.01); *G09G 2310/08* (2013.01); *G09G 2320/041* (2013.01)

(58) Field of Classification Search
None
See application file for complete search history.

(56) References Cited

U.S. PATENT DOCUMENTS

2007/0195041 A1* 8/2007 Lee ..... G09G 3/2074 345/89
2014/0111499 A1* 4/2014 Jang ..... G09G 3/3696 345/212
2014/0347341 A1* 11/2014 Pyun ..... G09G 3/3696 345/212
2016/0027412 A1* 1/2016 Igawa ..... G09G 3/3648 345/213

FOREIGN PATENT DOCUMENTS

KR 1020050112903 12/2005
KR 10-0734311 7/2007
KR 1020150050763 5/2015

* cited by examiner

*Primary Examiner* — Gustavo Polo
(74) *Attorney, Agent, or Firm* — F. Chau & Associates, LLC

(57) ABSTRACT

A display apparatus includes a display panel, a data driving circuit, and a gate driving circuit. The display panel is configured to display an image and includes a gate line and a data line. The data driving circuit is configured to output a data signal to the data line. The gate driving circuit is configured to output a gate signal to the gate line and to control a kick-back time of the gate signal according to a temperature of the display panel. The kick-back time is a time when the gate signal is decreased from a gate on voltage to a kick-back voltage that is between the gate on voltage and a gate off voltage.

19 Claims, 16 Drawing Sheets

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2016-0048084, filed on Apr. 20, 2016 in the Korean Intellectual Property Office (KIPO), the disclosure of which is incorporated by reference herein in its entirety.

TECHNICAL FIELD

Exemplary embodiments of the inventive concept relate to an image display, and more particularly, to a display apparatus and a method of driving the display apparatus.

DISCUSSION OF RELATED ART

A display apparatus includes a display panel and a display panel driving apparatus.

The display panel includes a lower substrate, an upper substrate, and a liquid crystal layer. The lower substrate includes a first base substrate, a gate line, a data line, a thin film transistor formed on the first base substrate, and a pixel electrode electrically connected to the thin film transistor. The upper substrate includes a second base substrate, a color filter formed on the second base substrate, and a common electrode formed on the color filter. The liquid crystal layer is formed between the lower substrate and the upper substrate, and includes a liquid crystal of which an arrangement is changed by an electric field between the pixel electrode and the common electrode.

The display panel driving apparatus includes a gate driving part, a data driving part, and a timing controlling part. The gate driving part outputs a gate signal to the gate line. The data driving part outputs a data signal to the data line. The timing controlling part controls timings of the gate driving part and the data driving part.

A temperature of the display panel may change due to an external environment or an internal environment. A temperature change of the display panel may cause a characteristic change of the thin film transistor in the display panel.

SUMMARY

According to an exemplary embodiment of the inventive concept, a display apparatus includes display panel, a data driving circuit, and a gate driving circuit. The display panel is configured to display an image and includes a gate line and a data line. The data driving circuit is configured to output a data signal to the data line. The gate driving circuit is configured to output a gate signal to the gate line and to control a kick-back time of the gate signal according to a temperature of the display panel. The kick-back time is a time when the gate signal is decreased from a gate on voltage to a kick-back voltage that is between the gate on voltage and a gate off voltage.

When the temperature of the display panel is in a first temperature range between a first temperature and a second temperature that is higher than the first temperature, the kick-back time may be a first kick-back time, and when the temperature of the display panel is in a second temperature range that is higher than the second temperature, the kick-back time may be a second kick-back time that is longer than the first kick-back time.

The display panel may include a thin film transistor electrically connected to the gate line and the data line. An activation time of the gate signal, during which the gate signal is not less than a threshold voltage of the thin film transistor, may be a first activation time when the temperature of the display panel is in the first temperature range, and the activation time of the gate signal may be a second activation time that is shorter than the first activation time when the temperature of the display panel is in the second temperature range that is higher than the second temperature.

When the temperature of the display panel is in a first temperature range between a first temperature and a second temperature that is higher than the first temperature, the kick-back time may be a first kick-back time, and when the temperature of the display panel is in a second temperature range that is lower than the first temperature, the kick-back time may be a second kick-back time that is shorter than the first kick-back time.

The display panel may include a thin film transistor electrically connected to the gate line and the data line. An activation time of the gate signal, during which the gate signal is not less than a threshold voltage of the thin film transistor, may be a first activation time when the temperature of the display panel is in the first temperature range, and the activation time of the gate signal may be a second activation time that is longer than the first activation time when the temperature of the display panel is in the second temperature range that is lower than the first temperature.

The display panel may include a thin film transistor electrically connected to the gate line and the data line. An activation time of the gate signal, during which the gate signal is not less than a threshold voltage of the thin film transistor, may be a first activation time when the temperature of the display panel is in a first temperature range between a first temperature and a second temperature that is higher than the first temperature, and the activation time of the gate signal may be a second activation time that is shorter than the first activation time when the temperature of the display panel is in a second temperature range that is higher than the second temperature.

The display panel may include a thin film transistor electrically connected to the gate line and the data line. An activation time of the gate signal, during which the gate signal is not less than a threshold voltage of the thin film transistor, may be a first activation time when the temperature of the display panel is in a first temperature range between a first temperature and a second temperature that is higher than the first temperature, and the activation time of the gate signal may be a second activation time that is longer than the first activation time when the temperature of the display panel is in a second temperature range that is lower than the first temperature.

The display apparatus may further include a temperature determining part configured to determine the temperature of the display panel and output a temperature determination signal.

The temperature determining part may include a variable resistor of which a resistance is changed according to the temperature of the display panel, a first resistor connected to the variable resistor in parallel, a second resistor connected between the first resistor and a ground voltage terminal, and a current source connected to the variable resistor and the first resistor, and configured to provide a current.

The display apparatus may further include a gate control signal outputting part configured to output a gate control signal according to the temperature determination signal.

The gate control signal may include a gate clock signal and a gate voltage control signal. The gate voltage control signal controls the gate on voltage and the gate off voltage.

The display apparatus may further include a plurality of gamma lookup tables corresponding to temperature ranges of the display panel.

The display apparatus may further include a plurality of Accurate Color Capture (ACC) lookup tables corresponding to temperature ranges of the display panel.

According to an exemplary embodiment of the inventive concept, a method of driving a display apparatus includes determining a temperature of a display panel which displays an image, controlling a kick-back time, according to a temperature of the display panel, to output a gate signal to a gate line of the display panel, and outputting a data signal to a data line of the display panel. The kick-back time is a time when the gate signal is decreased from a gate on voltage to a kick-back voltage that is between the gate on voltage and a gate off voltage When the temperature of the display panel is in a first temperature range between a first temperature and a second temperature that is higher than the first temperature, the kick-back time may be a first kick-back time, and when the temperature of the display panel is in a second temperature range that is higher than the second temperature, the kick-back time may be a second kick-back time that is longer than the first kick-back time.

When the temperature of the display panel is in a first temperature range between a first temperature and a second temperature that is higher than the first temperature, the kick-back time may be a first kick-back time, and when the temperature of the display panel is in a second temperature range that is lower than the first temperature, the kick-back time may be a second kick-back time that is shorter than the first kick-back time.

An activation time of the gate signal, during which the gate signal is not less than a threshold voltage of a thin film transistor electrically connected to the gate line and the data line of the display panel, may be a first activation time when the temperature of the display panel is in a first temperature range between a first temperature and a second temperature that is higher than the first temperature, and the activation time of the gate signal may be a second activation time that is shorter than the first activation time when the temperature of the display panel is in a second temperature range that is higher than the second temperature.

An activation time of the gate signal, during which the gate signal is not less than a threshold voltage of a thin film transistor electrically connected to the gate line and the data line of the display panel, may be a first activation time when the temperature of the display panel is in a first temperature range between a first temperature and a second temperature that is higher than the first temperature, and the activation time of the gate signal may be a second activation time that is longer than the first activation time when the temperature of the display panel is in a second temperature range that is lower than the first temperature.

The method may further include outputting gamma data by selecting one of a plurality of gamma lookup tables according to the temperature of the display panel.

The method may further include outputting Accurate Color Capture (ACC) data by selecting one of a plurality of ACC lookup tables according to the temperature of the display panel, and performing an ACC process on first image data using the ACC data to output second image data.

According to an exemplary embodiment of the inventive concept, in a method of driving a display apparatus including a display panel configured to display an image, a temperature of the display panel is determined. An activation time of a gate signal is controlled to be a first activation time when the temperature of the display panel is in a first temperature range, a second activation time when the temperature of the display panel is in a second temperature range that is greater than the first temperature range, and a third activation time when the temperature of the display panel is in a third temperature range that is less than the first temperature range. The gate signal is output to a gate line of the display panel. A data signal is output to a data line of the display panel. The activation time of the gate signal is a time when the gate signal is not less than a threshold voltage of a thin film transistor of a pixel included in the display panel. The second activation time is shorter than the first activation time and the third activation time is longer than the first activation time.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
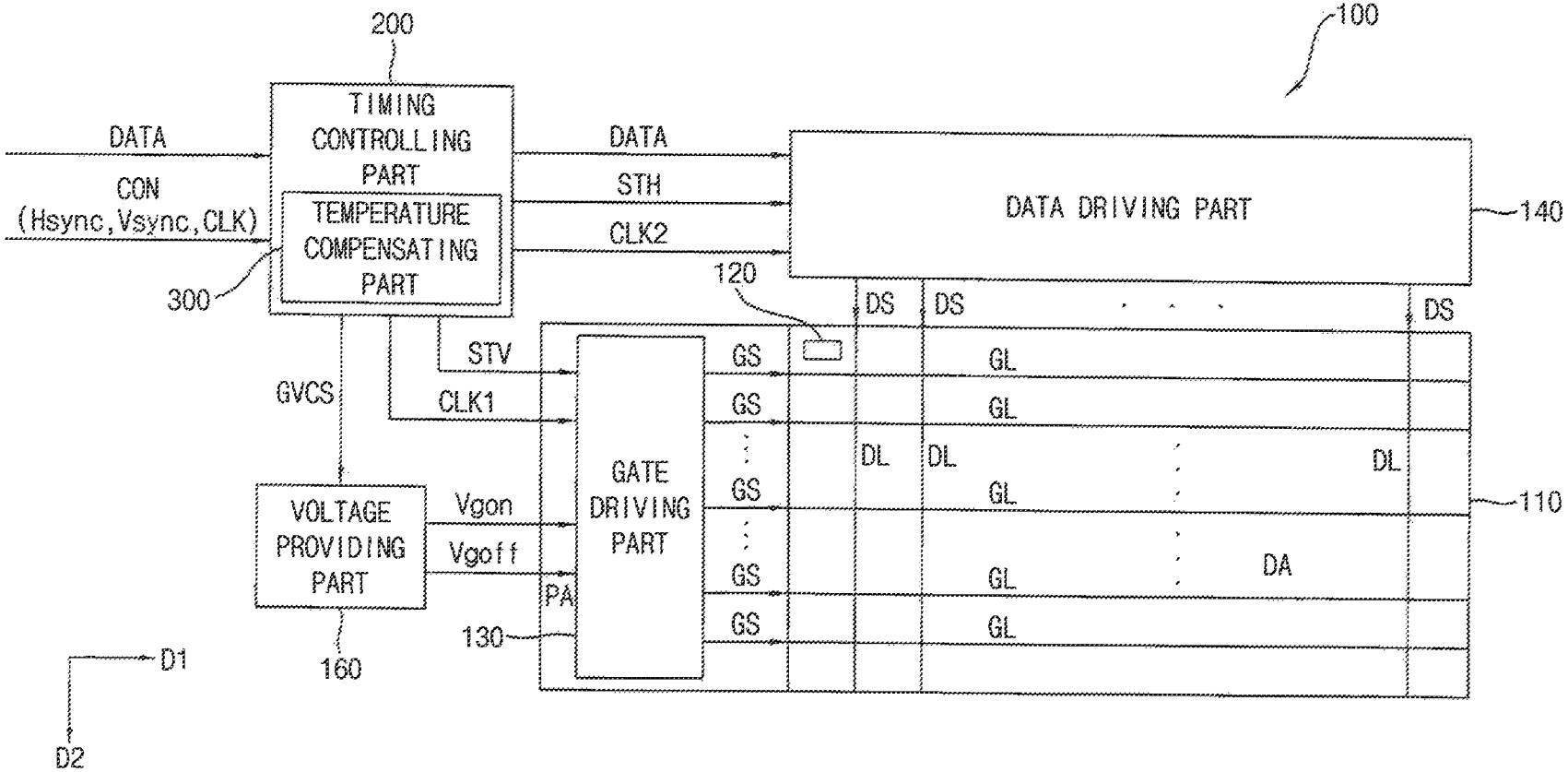
FIG. 1 is a block diagram illustrating a display apparatus according to an exemplary embodiment of the inventive concept.

Exemplary embodiments of the inventive concept will be described more fully hereinafter with reference to the accompanying drawings. Like reference numerals may refer to like elements throughout this application.

Exemplary embodiments of the inventive concept provide a display apparatus capable of increasing display quality of the display apparatus.

Exemplary embodiments of the inventive concept also provide a method of driving the above-mentioned display apparatus.

FIG. 1 is a block diagram illustrating a display apparatus according to an exemplary embodiment of the inventive concept.

Referring to FIG. 1, a display apparatus 100 according to the present exemplary embodiment includes a display panel 110, a gate driving part 130, a data driving part 140, a timing controlling part 200, and a voltage providing part 160.

The display panel 110 receives a data signal DS from the data driving part 140 to display an image.

The display panel 110 includes a display area DA and a peripheral area PA. The display area DA includes gate lines GL, data lines DL, and pixels 120. The gate lines GL extend in a first direction D1 and are arranged in a second direction D2 that is substantially perpendicular to the first direction D1. The data lines DL extend in the second direction D2 and are arranged in the first direction D1. Here, the first direction D1 may be parallel to a first side of the display panel 110, and the second direction D2 may be parallel to a second side of the display panel 110. For example, the first side of the display panel 110 may be longer than the second side of the display panel 110. The peripheral area PA includes the gate driving part 130.

Figure 2:
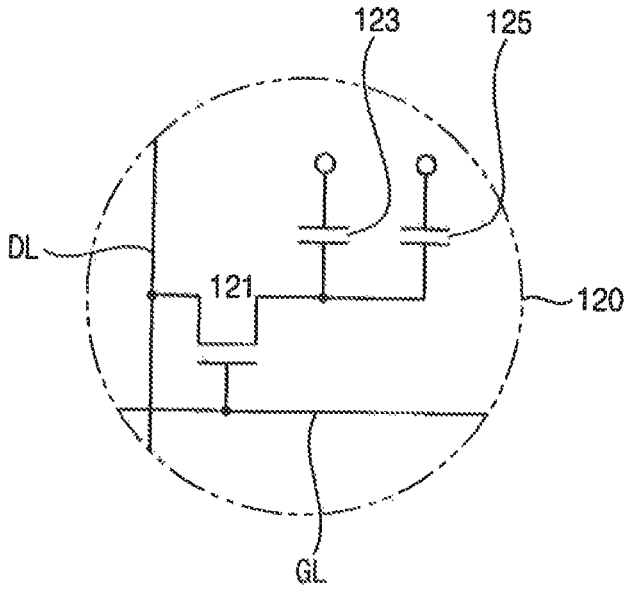
FIG. 2 is a circuit diagram illustrating a pixel of FIG. 1 according to an exemplary embodiment of the inventive concept.

FIG. 2 is a circuit diagram illustrating a pixel of FIG. 1 according to an exemplary embodiment of the inventive concept.

Referring to FIGS. 1 and 2, the pixels 120 are correspond to each of the gate lines GL and each of the data lines DL. With respect to FIG. 2, one of the pixels 120, one of the gate lines GL, and one of the data lines DL will be described, but the description may be applicable to each of the pixels 120, gate lines GL, and data lines DL. For example, the pixel 120 may include a thin film transistor 121 electrically connected to the gate line GL and the data line DL, a liquid crystal capacitor 123, and a storage capacitor 125 connected to the thin film transistor 121. Thus, the display panel 110 may be a liquid crystal display panel.

Referring to FIG. 1 again, the gate driving part 130, the data driving part 140, and the timing controlling part 200 may be referred to as a display panel driving apparatus for driving the display panel 110.

The gate driving part 130 generates a gate signal GS in response to a vertical start signal STV and a first clock signal CLK1 provided from the timing controlling part 200, and outputs the gate signal GS to the gate lines GL. As described above, the gate driving part 130 may be disposed in the peripheral area PA of the display panel 110. For example, the gate driving part 130 may be an Amorphous Silicon Gate (ASG). Thus, the gate driving part 130 may include a thin film transistor.

The data driving part 140 receives image data DATA from the timing controlling part 200, generates the data signal DS based on the image data DATA, and outputs the data signal DS to the data lines DL in response to a horizontal start signal STH and a second clock signal CLK2 provided from the timing controlling part 200.

The voltage providing part 160 outputs a gate on voltage Vgon and a gate off voltage Vgoff for generating the gate signal GS to the gate driving part 130. The voltage providing part 160 may output the gate on voltage Vgon and the gate off voltage Vgoff for controlling a voltage of the gate signal GS according to a gate voltage control signal GVCS output from the timing controlling part 200.

The timing controlling part 200 receives the image data DATA and a control signal CON from outside the display apparatus 100. The control signal CON may include a horizontal synchronous signal Hsync, a vertical synchronous signal Vsync, and a clock signal CLK. The timing controlling part 200 generates the horizontal start signal STH using the horizontal synchronous signal Hsync and outputs the horizontal start signal STH to the data driving part 140. In addition, the timing controlling part 200 generates the vertical start signal STV using the vertical synchronous signal Vsync and outputs the vertical start signal STV to the gate driving part 130. Furthermore, the timing controlling part 200 generates the first clock signal CLK1 and the second clock signal CLK2 using the clock signal CLK, outputs the first clock signal CLK1 to the gate driving part 130, and outputs the second clock signal CLK2 to the data driving part 140.

The timing controlling part 200 includes a temperature compensating part 300. The temperature compensating part 300 detects and determines a temperature of the display panel 110, and outputs a gate control signal for controlling the gate signal GS. For example, the gate control signal may include the first clock signal CLK1 and the gate voltage control signal GVCS.

Figure 3:
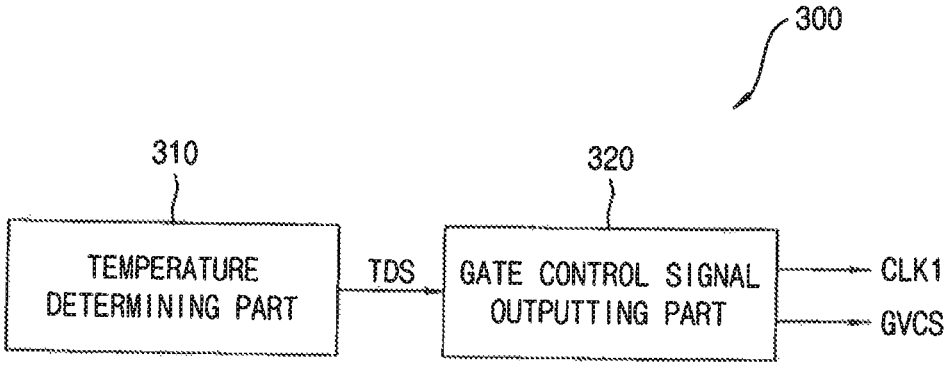
FIG. 3 is a block diagram illustrating a temperature compensating part of FIG. 1 according to an exemplary embodiment of the inventive concept.

FIG. 3 is a block diagram illustrating a temperature compensating part of FIG. 1 according to an exemplary embodiment of the inventive concept.

Referring to FIGS. 1 and 3, the temperature compensating part 300 may include a temperature determining part 310 and a gate control signal outputting part 320.

The temperature determining part 310 determines the temperature of the display panel 110 to output a temperature determination signal TDS to the gate control signal outputting part 320.

The gate control signal outputting part 320 receives the temperature determination signal TDS from the temperature determining part 310, and outputs the first clock signal CLK1 and the gate voltage control signal GVCS for controlling the gate signal GS, according to the temperature of the display panel 110 (e.g., in response to the temperature determination signal TDS).

Figure 4:
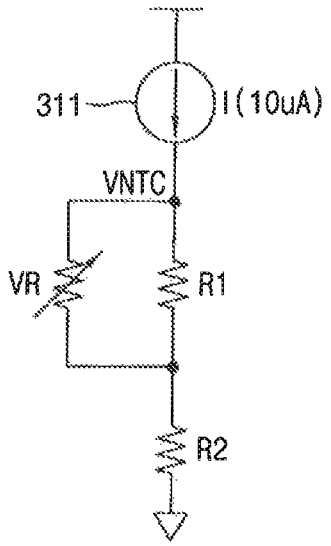
FIG. 4 is a circuit diagram illustrating a temperature determining part of FIG. 3 according to an exemplary embodiment of the inventive concept.

FIG. 4 is a circuit diagram illustrating a temperature determining part of FIG. 3 according to an exemplary embodiment of the inventive concept.

Referring to FIGS. 1, 3, and 4, the temperature determining part 310 may include a current source 311, a variable resistor VR, a first resistor R1, and a second resistor R2.

The current source 311 provides a current I. For example, the current I may be about 10 micro amperes (e.g., 10 μA). The current source 311 may be connected to a first terminal of the variable resistor VR and a first terminal of the first resistor R1.

The variable resistor VR includes its first terminal connected to the current source 311 and the terminal of the first resistor R1, and a second terminal connected to a second terminal of the first resistor R1 and a first terminal of the second resistor R2. A resistance of the variable resistor VR changes according to the temperature of the display panel 110. For example, the variable resistor VR may be a thermistor, such as a negative thermistor. Thus, the resistance of the variable resistor VR may decrease when the temperature of the display panel 110 increases.

The first resistor R1 is connected to the variable resistor VR in parallel. In other words, the first resistor R1 includes its first terminal connected to the first terminal of the variable resistor VR, and a second terminal connected to the second terminal of the variable resistor VR.

The second resistor R2 includes its first terminal connected to the second terminal of the variable resistor and the second terminal of the first resistor R1, and a second terminal connected to a ground voltage terminal to which a ground voltage is applied.

A temperature conversion voltage VNTC, obtained by converting the temperature of the display panel 110 into a voltage, is detected at a node where the variable resistor VR is connected to the current source 311. Thus, the temperature determining part 310 may determine the temperature of the display panel 110.

Figure 5:
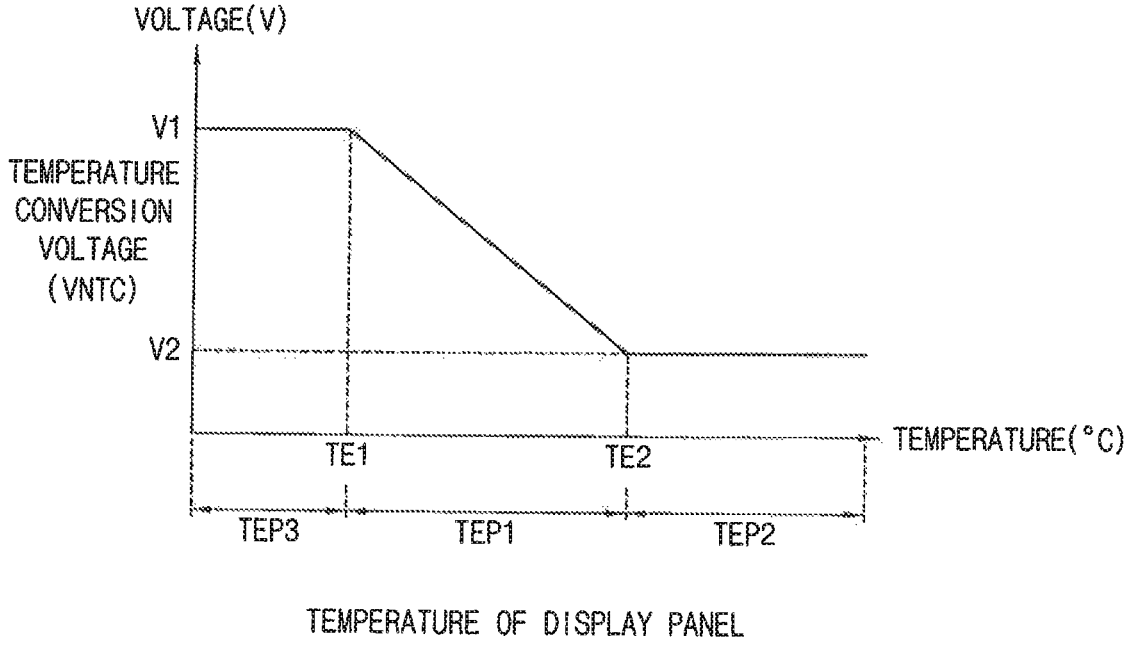
FIG. 5 is a graph illustrating a relation between a temperature of a display panel of FIG. 1 and a temperature conversion voltage of FIG. 4 according to an exemplary embodiment of the inventive concept.

FIG. 5 is a graph illustrating a relation between a temperature of a display panel of FIG. 1 and a temperature conversion voltage of FIG. 4 according to an exemplary embodiment of the inventive concept.

Referring to FIGS. 1 and 3 to 5, when the temperature of the display panel 110 is between a first temperature TE1 and a second temperature TE2 that is higher than the first temperature TE1, the temperature of the display panel 110 may be described as being within a first temperature range TEP1. For example, the first temperature TE1 may be about −10° C., and the second temperature TE2 may be about 25° C. When the temperature of the display panel 110 is higher than the second temperature TE2, the temperature of the display panel 110 may be described as being within a second temperature range TEP2. When the temperature of the display panel 110 is lower than the first temperature TE1, the temperature of the display panel 110 may be described as being within a third temperature range TEP3. As an example, the first temperature range TEP1 may be a room temperature (or a normal temperature), the second temperature range TEP2 may be a high temperature, and the third temperature range TEP3 may be a low temperature.

When the temperature of the display panel 110 is in the first temperature range TEP1, the temperature conversion voltage VNTC may be between a first voltage V1 and a second voltage V2 that is lower than the first voltage V1. For example, when the temperature of the display panel 110 is the first temperature TE1, the temperature conversion voltage VNTC may be the first voltage V1. When the temperature of the display panel 110 is the second temperature TE2, the temperature conversion voltage VNTC may be the second voltage V2. The temperature conversion voltage VNTC may linearly decrease as the temperature of the display panel 110 increases within the first temperature range TEP1. As an example, the first voltage V1 may be about 28 volts (V), and the second voltage V2 may be about 37 volts (V).

When the temperature of the display panel 110 is in the second temperature range TEP2, the temperature conversion voltage VNTC may be the second voltage V2.

When the temperature of the display panel 110 is in the third temperature range TEP3, the temperature conversion voltage VNTC may be the first voltage V1.

Figure 6A:
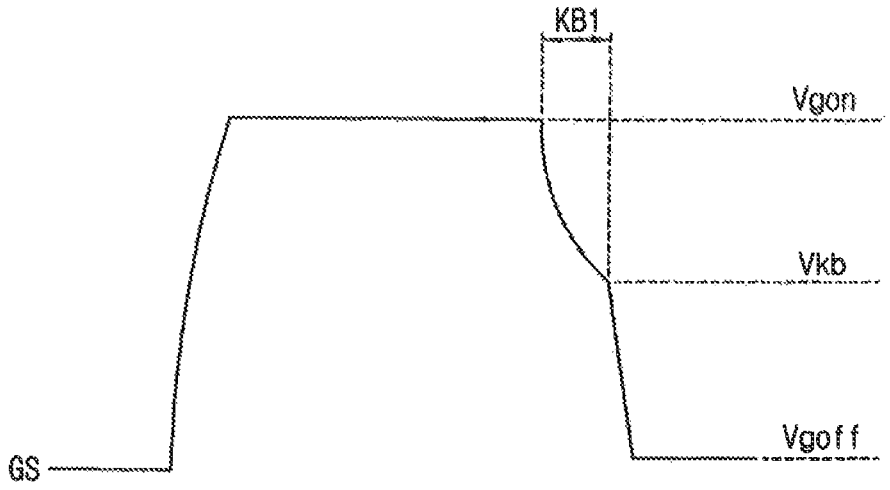
FIGS. 6A to 6C are timing diagrams illustrating a gate signal according to the temperature of the display panel of FIG. 1 according to an exemplary embodiment of the inventive concept.
Figure 6B:
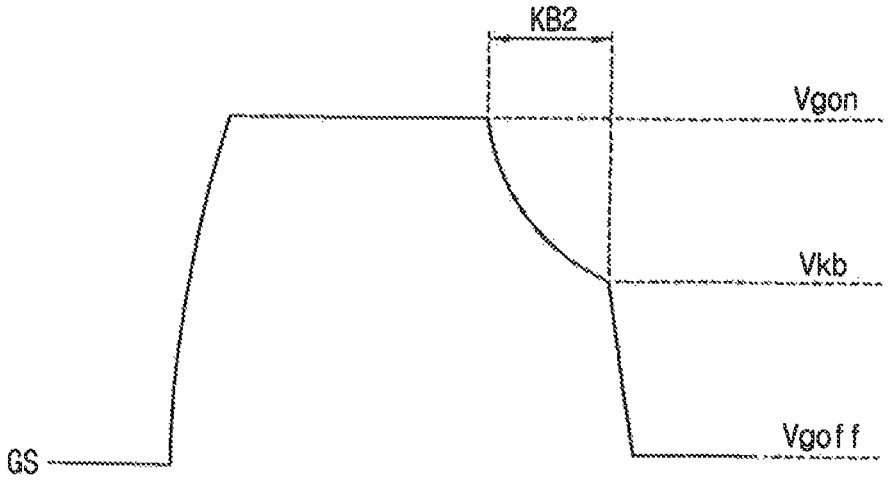
Figure 6C:
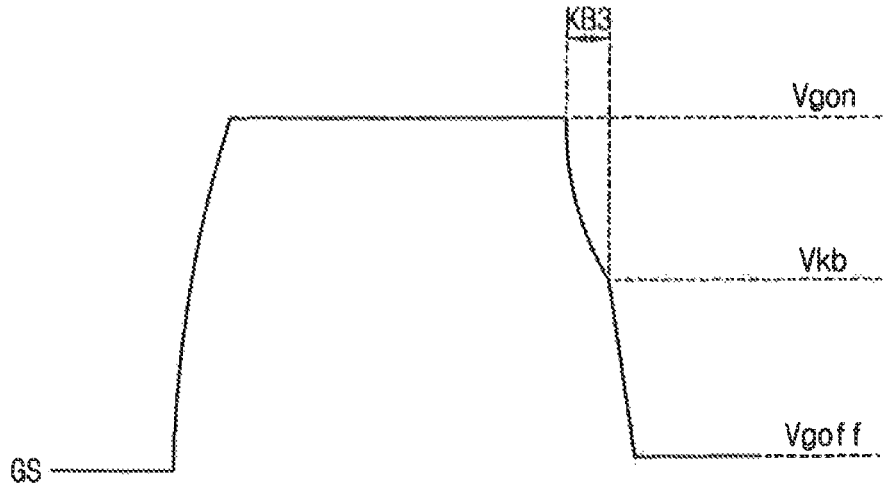

FIGS. 6A to 6C are timing diagrams illustrating a gate signal according to the temperature of the display panel of FIG. 1 according to an exemplary embodiment of the inventive concept.

Referring to FIGS. 1 and 3 to 6C, a level of the gate signal GS may include the gate off voltage Vgoff and the gate on voltage Vgon. In addition, the level of the gate signal GS may include a kick-back voltage Vkb that is between the gate off voltage Vgoff and the gate on voltage Vgon.

As shown in FIG. 6A, when the temperature of the display panel 110 is in the first temperature range TEP1, a kick-back time when the gate signal GS is decreased from the gate on voltage Vgon to the kick-back voltage Vkb may be a first kick-back time KB1.

As shown in FIG. 6B, when the temperature of the display panel 110 is in the second temperature range TEP2, the kick-back time when the gate signal GS is decreased from the gate on voltage Vgon to the kick-back voltage Vkb may be a second kick-back time KB2. Here, the second kick-back time KB2 is longer than the first kick-back time KB1. Therefore, although the temperature of the display panel 110 is increased from the first temperature range TEP1 to the second temperature range TEP2, a data charge rate in which a data voltage is charged to the pixel 120 may be uniformly maintained.

As shown in FIG. 6C, when the temperature of the display panel 110 is in the third temperature range TEP3, the kick-back time when the gate signal GS is decreased from the gate on voltage Vgon to the kick-back voltage Vkb may have a third kick-back time KB3. Here, the third kick-back time KB3 is shorter than the first kick-back time KB1. Therefore, although the temperature of the display panel 110 is decreased from the first temperature range TEP1 to the third temperature range TEP3, the data charge rate in which the data voltage is charged to the pixel 120 may be uniformly maintained.

Figure 7:
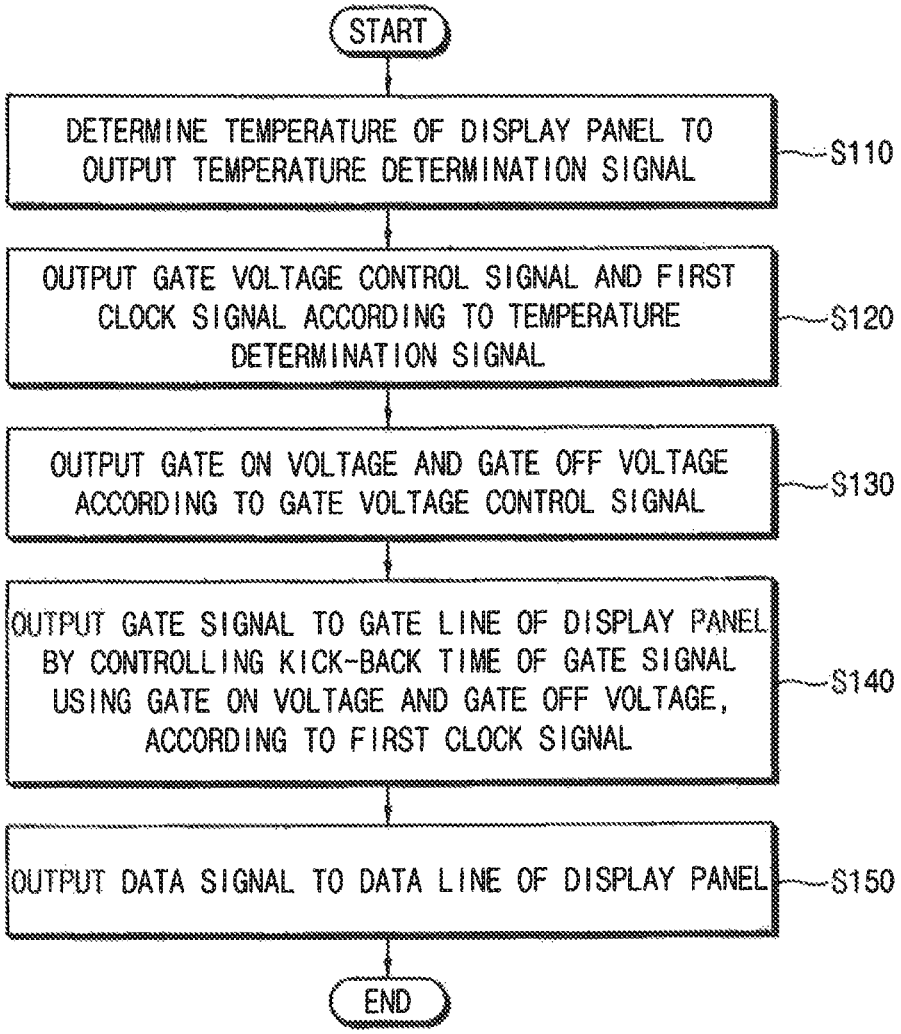
FIG. 7 is a flowchart illustrating a method of driving the display apparatus of FIG. 1 according to an exemplary embodiment of the inventive concept.

FIG. 7 is a flowchart illustrating a method of driving the display apparatus of FIG. 1 according to an exemplary embodiment of the inventive concept.

Referring to FIGS. 1 and 3 to 7, the temperature of the display panel 110 is determined and the temperature determination signal TDS is output (operation S110). For example, the temperature determining part 310 determines the temperature of the display panel 110 to output the temperature determination signal TDS to the gate control signal outputting part 320.

The gate voltage control signal GVCS and the first clock signal CLK1 are output according to the temperature determination signal TDS (operation S120). For example, the gate control signal outputting part 320 receives the temperature determination signal TDS from the temperature determining part 310, and outputs the first clock signal CLK1 and the gate voltage control signal GVCS for controlling the gate signal GS according to the temperature of the display panel 110 (e.g., in response to the temperature determination signal TDS).

The gate on voltage Vgon and the gate off voltage Vgoff are output according to the gate voltage control signal GVCS (operation S130). For example, the voltage providing part 160 outputs the gate on voltage Vgon and the gate off voltage Vgoff for controlling the voltage of the gate signal GS according to the gate voltage control signal GVCS output from the gate control signal outputting part 320 of the timing controlling part 200.

The gate signal GS is output to the gate line GL of the display panel 110 by controlling the kick-back time of the gate signal GS using the gate on voltage Vgon and the gate off voltage Vgoff, according to the first clock signal CLK1 (operation S140).

For example, as described above, when the temperature of the display panel 110 is in the first temperature range TEP1, the kick-back time when the gate signal GS is decreased from the gate on voltage Vgon to the kick-back voltage Vkb may be the first kick-back time KB1. When the temperature of the display panel 110 is in the second temperature range TEP2, the kick-back time when the gate signal GS is decreased from the gate on voltage Vgon to the kick-back voltage Vkb may be the second kick-back time KB2. Here, the second kick-back time KB2 is longer than the first kick-back time KB1. When the temperature of the display panel 110 is in the third temperature range TEP3, the kick-back time when the gate signal GS is decreased from the gate on voltage Vgon to the kick-back voltage Vkb may be the third kick-back time KB3. Here, the third kick-back time KB3 is shorter than the first kick-back time KB1.

The data signal DS is output to the data lines DL of the display panel 110 (operation S150). For example, the data driving part 140 receives the image data DATA from the timing controlling part 200, generates the data signal DS based on the image data DATA, and outputs the data signal DS to the data lines DL in response to the horizontal start signal STH and the second clock signal CLK2 provided from the timing controlling part 200.

In the present exemplary embodiment, the gate driving part 130 is disposed in the display panel 110, but the inventive concept is not limited thereto. For example, the gate driving part 130 may be disposed outside the display panel 110.

In the present exemplary embodiment, the temperature range of the display panel 110 includes the first temperature range TEP1, the second temperature range TEP2, and the third temperature range TEP3, but the inventive concept is not limited thereto. For example, the temperature range of the display panel 110 may include N (where N is a natural number greater than two) temperature ranges.

According to the present exemplary embodiment, the kick-back time when the gate signal GS is decreased from the gate on voltage Vgon to the kick-back voltage Vkb is the first kick-back time KB1 in the first temperature range TEP1 (e.g., a room temperature range), the second kick-back time KB2 that is longer than the first kick-back time KB1 in the second temperature range TEP2 (e.g., a high temperature range), and the third kick-back time KB3 that is shorter than the first kick-back time KB1 in the third temperature range TEP3 (e.g., a low temperature range). Therefore, the data charge rate in which the data voltage is charged to the pixel 120 may be uniformly maintained regardless of a temperature change of the display panel 110. Thus, display quality of the display apparatus 100 may be increased.

Figure 8A:
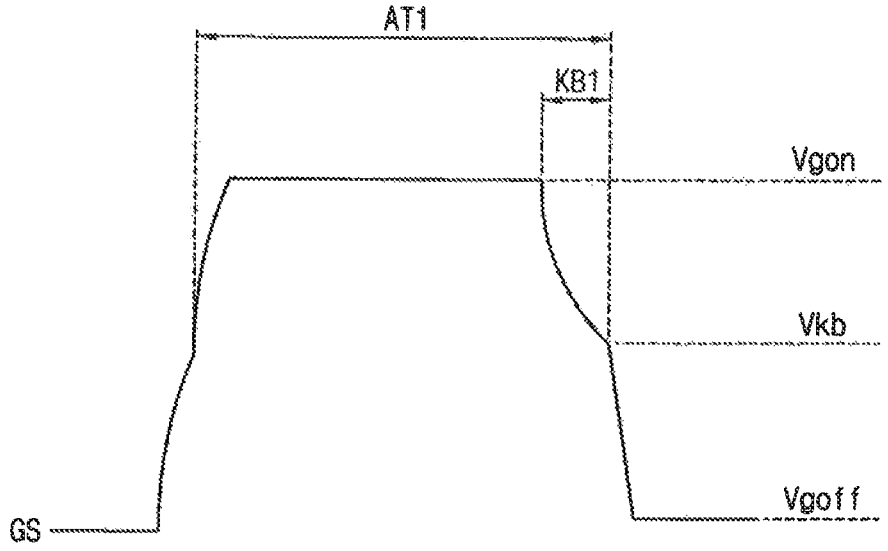
FIGS. 8A to 8C are timing diagrams illustrating a gate signal according to an exemplary embodiment of the inventive concept.
Figure 8B:
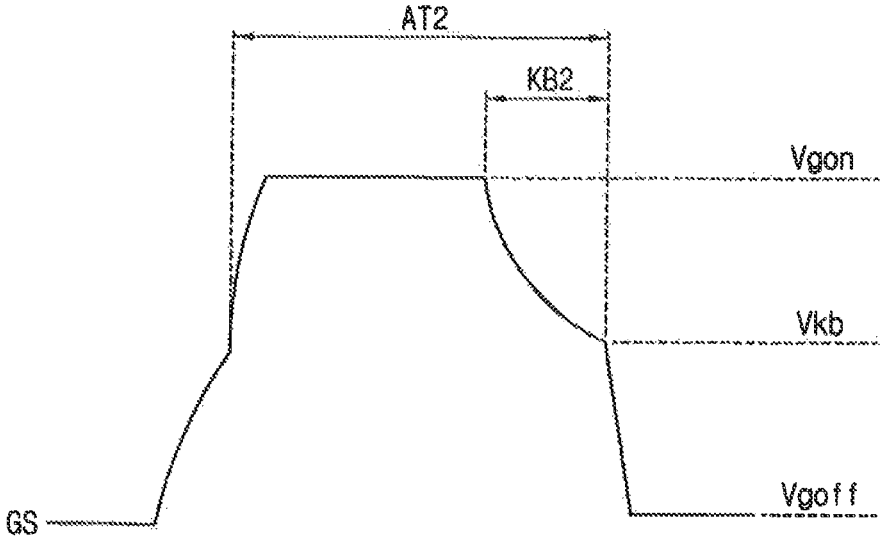
Figure 8C:
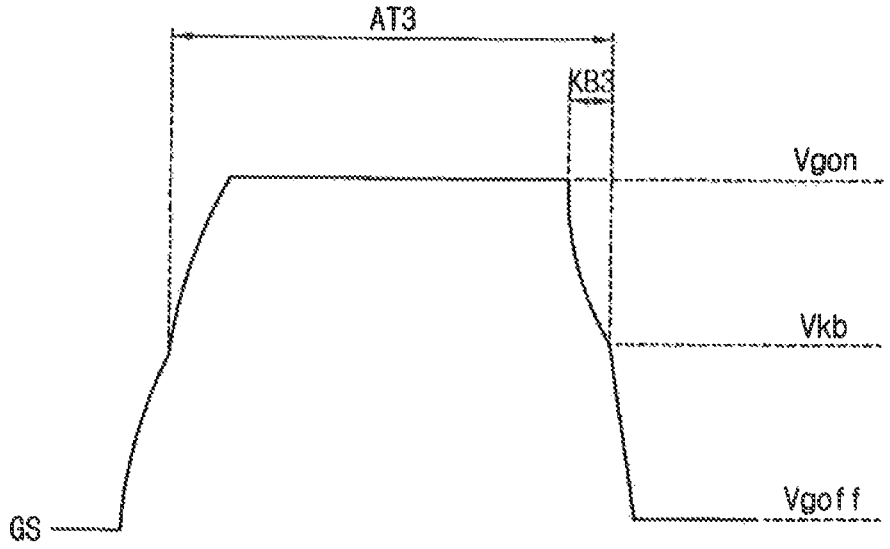

FIGS. 8A to 8C are timing diagrams illustrating a gate signal according to an exemplary embodiment of the inventive concept.

The gate signal GS, according to the present exemplary embodiment illustrated in FIGS. 8A to 8C, may be output from the gate driving part 130 of FIG. 1. Thus, the same reference numerals will be used to refer to same or like parts as those described previously and repeat explanations will be omitted.

Referring to FIGS. 1, 5, and 8A to 8C, when the temperature of the display panel 110 is in the first temperature range TEP1, an activation time when the gate signal GS is not less than a threshold voltage of the thin film transistor 121 in the pixel 120 may be a first activation time AT1. During the first activation time AT1, the kick-back time when the gate signal GS is decreased from the gate on voltage Vgon to the kick-back voltage Vkb may be the first kick-back time KB1.

When the temperature of the display panel 110 is in the second temperature range TEP2, the activation time may be a second activation time AT2. Here, the second activation time AT2 is shorter than the first activation time AT1. During the second activation time AT2, the kick-back time may be the second kick-back time KB2 that is longer than the first kick-back time KB1. Therefore, although the temperature of the display panel 110 is increased from the first temperature range TEP1 to the second temperature range TEP2, the data charge rate in which the data voltage is charged to the pixel 120 may be uniformly maintained.

When the temperature of the display panel 110 is in the third temperature range TEP3, the activation time may be a third activation time AT3. Here, the third activation time AT3 is longer than the first activation time AT1. During the third activation time AT3, the kick-back time may be the third kick-back time KB3 that is shorter than the first kick-back time KB1. Therefore, although the temperature of the display panel 110 is decreased from the first temperature range TEP1 to the third temperature range TEP3, the data charge rate in which the data voltage is charged to the pixel 120 may be uniformly maintained.

Figure 9:
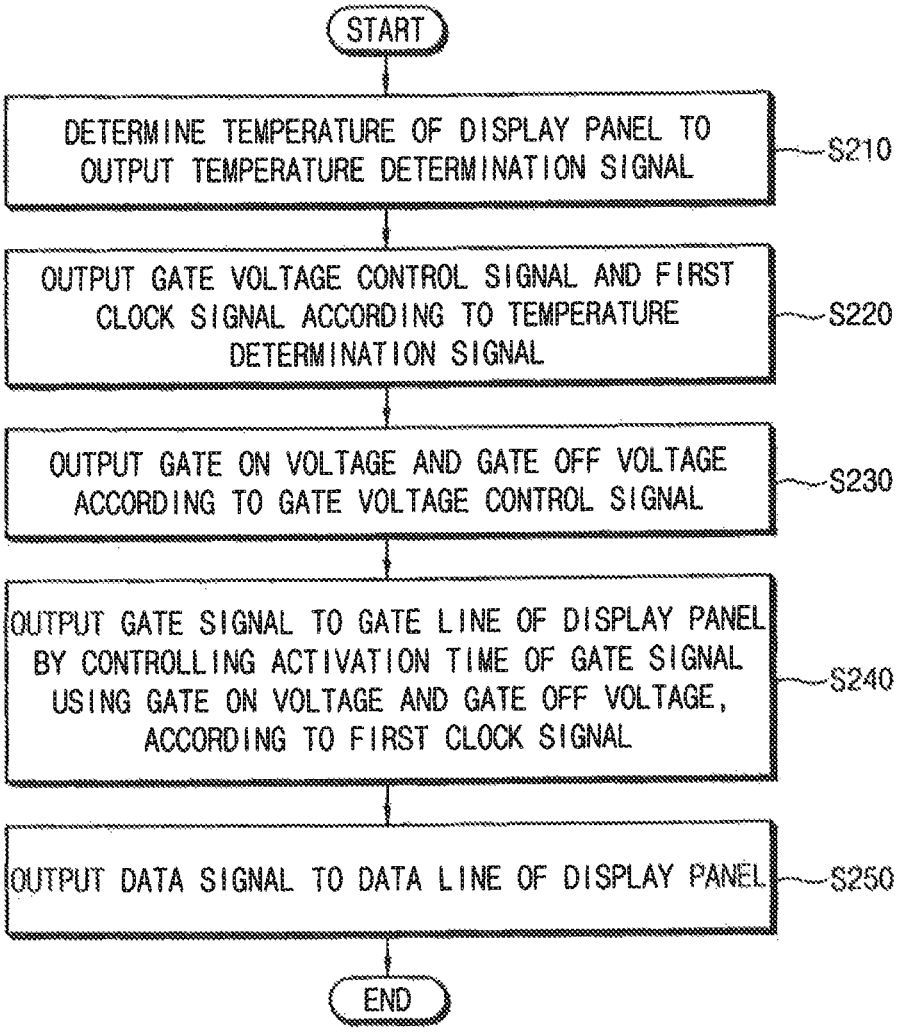
FIG. 9 is flowchart illustrating a method of driving a display apparatus including a gate driving part of FIG. 1 outputting the gate signal illustrated in FIGS. 8A to 8C according to an exemplary embodiment of the inventive concept.

FIG. 9 is flowchart illustrating a method of driving a display apparatus including a gate driving part of FIG. 1 outputting the gate signal illustrated in FIGS. 8A to 8C according to an exemplary embodiment of the inventive concept.

Referring to FIGS. 1, 3 to 5, and 8A to 9, the temperature of the display panel 110 is determined and the temperature determination signal TDS is output (operation S210). For example, the temperature determining part 310 determines the temperature of the display panel 110 to output the temperature determination signal TDS to the gate control signal outputting part 320.

The gate voltage control signal GVCS and the first clock signal CLK1 are output according to the temperature determination signal TDS (operation S220). For example, the gate control signal outputting part 320 receives the temperature determination signal TDS from the temperature determining part 310, and outputs the first clock signal CLK1 and the gate voltage control signal GVCS for controlling the gate signal GS according to the temperature of the display panel 110 (e.g., in response to the temperature determination signal TDS).

The gate on voltage Vgon and the gate off voltage Vgoff are output according to the gate voltage control signal GVCS (operation S230). For example, the voltage providing part 160 outputs the gate on voltage Vgon and the gate off voltage Vgoff for controlling the voltage of the gate signal GS according to the gate voltage control signal GVCS output from the gate control signal outputting part 320 of the timing controlling part 200.

The gate signal GS is output to the gate lines GL of the display panel 110 by controlling the activation time of the gate signal GS using the gate on voltage Vgon and the gate off voltage Vgoff, according to the first clock signal CLK1 (operation S240).

For example, as described above, when the temperature of the display panel 110 is in the first temperature range TEP1, the activation time when the gate signal GS is not less than the threshold voltage of the thin film transistor 121 in the pixel 120 may be the first activation time AT1. When the temperature of the display panel 110 is in the second temperature range TEP2, the activation time may be the second activation time AT2. Here, the second activation time AT2 is shorter than the first activation time AT1. When the temperature of the display panel 110 is in the third temperature range TEP3, the activation time may be the third activation time AT3. Here, the third activation time AT3 is longer than the first activation time AT1.

The data signal DS is output to the data lines DL of the display panel 110 (operation S250). For example, the data driving part 140 receives the image data DATA from the timing controlling part 200, generates the data signal DS based on the image data DATA, and outputs the data signal DS to the data lines DL in response to the horizontal start signal STH and the second clock signal CLK2 provided from the timing controlling part 200.

According to the present exemplary embodiment, as described above, the activation time is the first activation time AT1 in the first temperature range TEP1 (e.g., the room temperature range), the second activation time AT2 that is shorter than the first activation time AT1 in the second temperature range TEP2 (e.g., the high temperature range), and the third activation time AT3 that is longer than the first activation time AT1 in the third temperature range TEP3 (e.g., the low temperature range). Therefore, the data charge rate in which the data voltage is charged to the pixel 120 may be uniformly maintained regardless of the temperature change of the display panel 110. Thus, display quality of the display apparatus may be improved.

Figure 10:
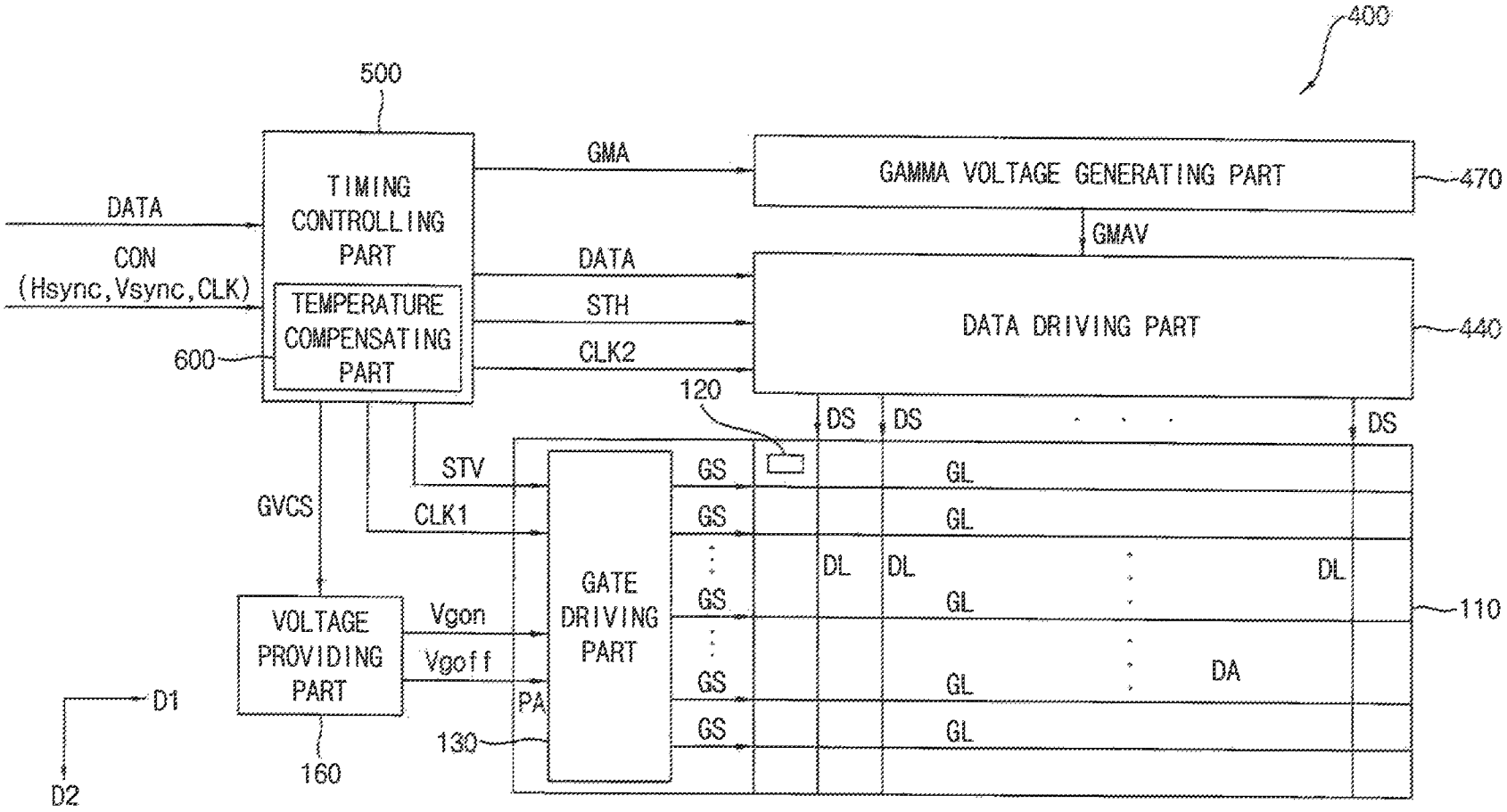
FIG. 10 is a block diagram illustrating a display apparatus according to an exemplary embodiment of the inventive concept.

FIG. 10 is a block diagram illustrating a display apparatus according to an exemplary embodiment of the inventive concept.

A display apparatus 400, according to the present exemplary embodiment illustrated in FIG. 10, is substantially the same as the display apparatus 100 of FIG. 1, except for a data driving part 440, a timing controlling part 500, a temperature compensating part 600, and a gamma voltage generating part 470. Thus, the same reference numerals will be used to refer to the same or like parts as those described previously and repeat explanations will be omitted.

Referring to FIG. 10, the display apparatus 400 includes the display panel 110, the gate driving part 130, the data driving part 440, the timing controlling part 500, the voltage providing part 160, and the gamma voltage generating part 470.

The gate driving part 130, the data driving part 440, and the timing controlling part 500 may be referred to as a display panel driving apparatus for driving the display panel 110.

The gate driving part 130 generates the gate signal GS in response to the vertical start signal STV and the first clock signal CLK1 provided from the timing controlling part 500, and outputs the gate signal GS to the gate lines GL.

The data driving part 440 receives the image data DATA from the timing controlling part 500 and receives a gamma voltage GMAV from the gamma voltage generating part 470. The data driving part 440 generates the data signal DS using the gamma voltage GMAV, based on the image data DATA. The data driving part 440 outputs the data signal DS to the data lines DL in response to the horizontal start signal STH and the second clock signal CLK2 provided from the timing controlling part 500.

The voltage providing part 160 may output the gate on voltage Vgon and the gate off voltage Vgoff for controlling the voltage of the gate signal GS according to the gate voltage control signal GVCS output from the timing controlling part 500.

The timing controlling part 500 receives the image data DATA and the control signal CON from outside the display apparatus 400. The control signal CON may include the horizontal synchronous signal Hsync, the vertical synchronous signal Vsync, and the clock signal CLK. The timing controlling part 500 generates the horizontal start signal STH using the horizontal synchronous signal Hsync and outputs the horizontal start signal STH to the data driving part 440. In addition, the timing controlling part 500 generates the vertical start signal STV using the vertical synchronous signal Vsync and outputs the vertical start signal STV to the gate driving part 130. Furthermore, the timing controlling part 500 generates the first clock signal CLK1 and the second clock signal CLK2 using the clock signal CLK, outputs the first clock signal CLK1 to the gate driving part 130, and outputs the second clock signal CLK2 to the data driving part 440.

The timing controlling part 500 includes the temperature compensating part 600. The temperature compensating part 600 detects and determines the temperature of the display panel 110, and outputs the gate control signal for controlling the gate signal GS. For example, the gate control signal may include the first clock signal CLK1 and the gate voltage control signal GVCS. In addition, the temperature compensating part 600 outputs gamma data GMA, according to the temperature of the display panel 110, to the gamma voltage generating part 470.

The gamma voltage generating part 470 generates the gamma voltage GMAV according to the gamma data GMA output from the timing controlling part 500, and outputs the gamma voltage GMAV to the data driving part 440.

Figure 11:
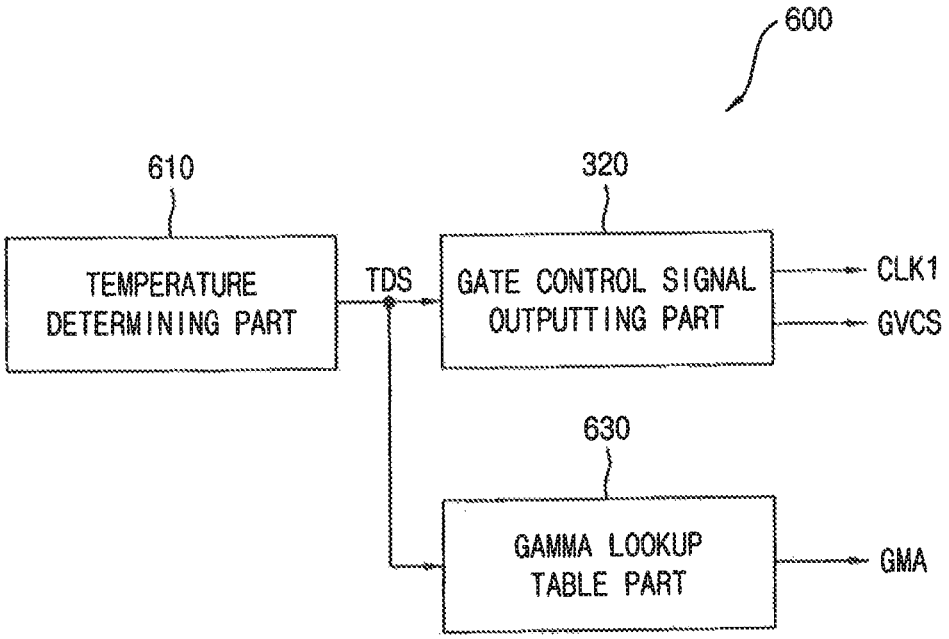
FIG. 11 is a block diagram illustrating a temperature compensating part of FIG. 10 according to an exemplary embodiment of the inventive concept.

FIG. 11 is a block diagram illustrating a temperature compensating part of FIG. 10 according to an exemplary embodiment of the inventive concept.

Referring to FIGS. 10 and 11, the temperature compensating part 600 may include a temperature determining part 610, the gate control signal outputting part 320, and a gamma lookup table part 630.

The temperature determining part 610 determines the temperature of the display panel 110, and outputs the temperature determination signal TDS to the gate control signal outputting part 320 and the gamma lookup table part 630. In other words, the temperature determination signal TDS indicates the temperature of the display panel 110. The temperature determining part 610 may be substantially the same as the temperature determining part 310 of FIG. 3.

The gamma lookup table part 630 outputs the gamma data GMA according to the temperature determination signal TDS output from the temperature determining part 610.

Figure 12:
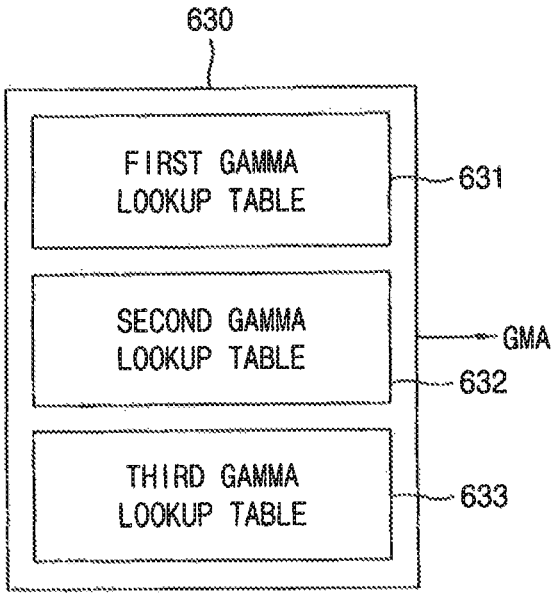
FIG. 12 is a block diagram illustrating a gamma lookup table part of FIG. 11 according to an exemplary embodiment of the inventive concept.

FIG. 12 is a block diagram illustrating a gamma lookup table part of FIG. 11 according to an exemplary embodiment of the inventive concept.

Referring to FIGS. 11 and 12, the gamma lookup table part 630 may include a first gamma lookup table 631, a second gamma lookup table 632, and a third gamma lookup table 633. The first gamma lookup table 631, the second gamma lookup table 632, and the third gamma lookup table 633 may store pieces of the gamma data GMA suitable for the temperature ranges of the display panel 110. For example, the first gamma lookup table 631 may store gamma data GMA suitable for the first temperature range TEP1 illustrated in FIG. 5, the second gamma lookup table 632 may store gamma data GMA suitable for the second temperature range TEP2 illustrated in FIG. 5, and the third gamma lookup table 633 may store gamma data GMA suitable for the third temperature range TEP3 illustrated in FIG. 5.

When the temperature of the display panel 110 is in the first temperature range TEP1, the temperature compensating part 600 may output the gamma data GMA from the first gamma lookup table 631. When the temperature of the display panel 110 is in the second temperature range TEP2, the temperature compensating part 600 may output the gamma data GMA from the second gamma lookup table 632. When the temperature of the display panel 110 is in the third temperature range TEP3, the temperature compensating part 600 may output the gamma data GMA from the third gamma lookup table 633.

The gamma lookup table part 630 may further include a gamma lookup table selector for selecting one of the first gamma lookup table 631, the second gamma lookup table 632, and the third gamma lookup table 633 according to the temperature determination signal TDS.

Figure 13:
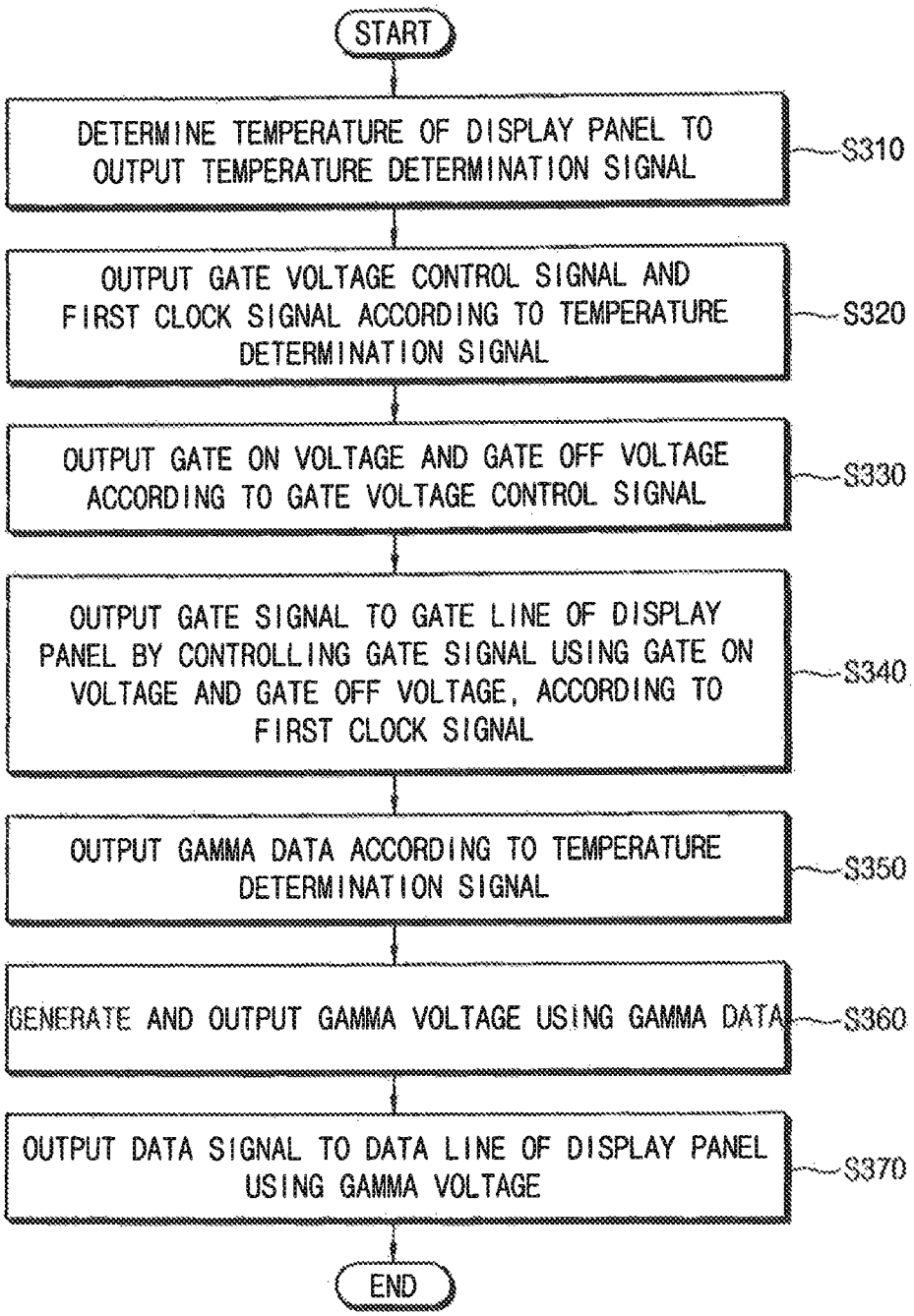
FIG. 13 is flowchart illustrating a method of driving the display apparatus of FIG. 10 according to an exemplary embodiment of the inventive concept.

FIG. 13 is flowchart illustrating a method of driving the display apparatus of FIG. 10 according to an exemplary embodiment of the inventive concept.

Referring to FIGS. 5 and 10 to 13, the temperature of the display panel 110 is determined and the temperature determination signal TDS is output (operation S310). For example, the temperature determining part 610 determines the temperature of the display panel 110 to output the temperature determination signal TDS to the gate control signal outputting part 320 and the gamma lookup table part 630.

The gate voltage control signal GVCS and the first clock signal CLK1 are output according to the temperature determination signal TDS (operation S320). For example, the gate control signal outputting part 320 receives the temperature determination signal TDS from the temperature determining part 610, and outputs the first clock signal CLK1 and the gate voltage control signal GVCS for controlling the gate signal GS according to the temperature of the display panel 110 (e.g., in response to the temperature determination signal TDS).

The gate on voltage Vgon and the gate off voltage Vgoff are output according to the gate voltage control signal GVCS (operation S330). For example, the voltage providing part 160 outputs the gate on voltage Vgon and the gate off voltage Vgoff for controlling the voltage of the gate signal GS according to the gate voltage control signal GVCS output from the gate control signal outputting part 320 of the timing controlling part 500.

The gate signal GS is output to the gate lines GL of the display panel 110 by controlling the gate signal GS using the gate on voltage Vgon and the gate off voltage Vgoff, according to the first clock signal CLK1 (operation S340).

The gamma data GMA is output according to the temperature determination signal TDS (operation S350). For example, as described above, the gamma lookup table part 630 may include the first gamma lookup table 631, the second gamma lookup table 632, and the third gamma lookup table 633. The first gamma lookup table 631, the second gamma lookup table 632, and the third gamma lookup table 633 may store the pieces of the gamma data GMA suitable for the temperature ranges of the display panel 110. For example, the first gamma lookup table 631 may store the gamma data GMA suitable for the first temperature range TEP1 illustrated in FIG. 5, the second gamma lookup table 632 may store the gamma data GMA suitable for the second temperature range TEP2 illustrated in FIG. 5, and the third gamma lookup table 633 may store the gamma data GMA suitable for the third temperature range TEP3 illustrated in FIG. 5.

When the temperature of the display panel 110 is in the first temperature range TEP1, the temperature compensating part 600 may output the gamma data GMA from the first gamma lookup table 631. When the temperature of the display panel 110 is in the second temperature range TEP2, the temperature compensating part 600 may output the gamma data GMA from the second gamma lookup table 632. When the temperature of the display panel 110 is in the third temperature range TEP3, the temperature compensating part 600 may output the gamma data GMA from the third gamma lookup table 633.

The gamma voltage GMAV is generated and output using the gamma data GMA (operation S360). For example, the gamma voltage generating part 470 generates the gamma voltage GMAV according to the gamma data GMA output from the timing controlling part 500, and outputs the gamma voltage GMAV to the data driving part 440.

The data signal DS is output to the data lines DL of the display panel 110 using the gamma voltage GMAV (operation S370). For example, the data driving part 440 receives the image data DATA from the timing controlling part 500 and receives the gamma voltage GMAV from the gamma voltage generating part 470. The data driving part 440 generates the data signal DS using the gamma voltage GMAV, based on the image data DATA. The data driving part 440 outputs the data signal DS to the data lines DL in response to the horizontal start signal STH and the second clock signal CLK2 provided from the timing controlling part 500.

In the present exemplary embodiment, the gamma lookup table part 630 includes the first gamma lookup table 631, the second gamma lookup table 632, and the third gamma lookup table 633, as illustrated in FIG. 12, but the inventive concept is not limited thereto. For example, the gamma lookup table part 630 may include N (where N is a natural number not less than two) gamma lookup tables, corresponding to the number of temperature ranges of the display panel 110.

According to the present exemplary embodiment, since the gamma data GMA is adaptively provided to the gamma voltage generating part 470 based on the temperature change of the display panel 110, a decrease of display quality of the display apparatus 400 due to the temperature change of the display panel 110 may be prevented.

Figure 14:
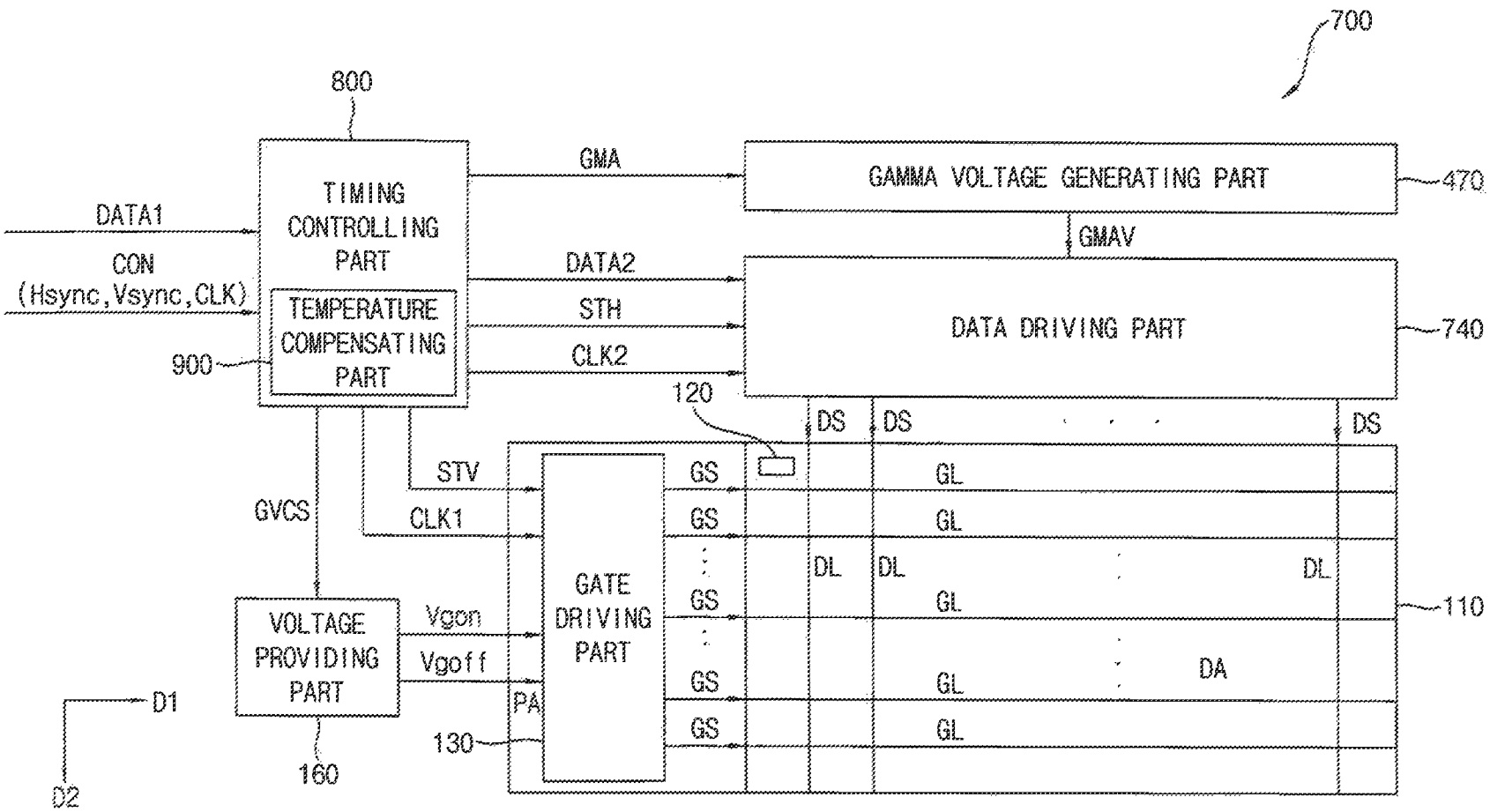
FIG. 14 is a block diagram illustrating a display apparatus according to an exemplary embodiment of the inventive concept.

FIG. 14 is a block diagram illustrating a display apparatus according to an exemplary embodiment of the inventive concept.

A display apparatus 700, according to the present exemplary embodiment illustrated in FIG. 14, is substantially the same as the display apparatus 100 of FIG. 1, except for a data driving part 740, a timing controlling part 800, a temperature compensating part 900, and a gamma voltage generating part 470. Thus, the same reference numerals will be used to refer to the same or like parts as those described previously and repeat explanations will be omitted.

Referring to FIG. 14, the display apparatus 700 includes the display panel 110, the gate driving part 130, the data driving part 740, the timing controlling part 800, the voltage providing part 160, and the gamma voltage generating part 470.

The gate driving part 130, the data driving part 740, and the timing controlling part 800 may be referred to as a display panel driving apparatus for driving the display panel 110.

The gate driving part 130 generates the gate signal GS in response to the vertical start signal STV and the first clock signal CLK1 provided from the timing controlling part 800, and outputs the gate signal GS to the gate lines GL.

The data driving part 740 receives second image data DATA2, which is generated based on first image data DATA1, and receives the gamma voltage GMAV from the gamma voltage generating part 470. The data driving part 740 generates the data signal DS using the gamma voltage GMAV, based on the second image data DATA2. The data driving part 740 outputs the data signal DS to the data lines DL in response to the horizontal start signal STH and the second clock signal CLK2 provided from the timing controlling part 800.

The voltage providing part 160 may output the gate on voltage Vgon and the gate off voltage Vgoff for controlling the voltage of the gate signal GS according to the gate voltage control signal GVCS output from the timing controlling part 800.

The timing controlling part 800 receives the first image data DATA1 and the control signal CON from outside the display apparatus 700. The control signal CON may include the horizontal synchronous signal Hsync, the vertical synchronous signal Vsync, and the clock signal CLK. The timing controlling part 800 generates the horizontal start signal STH using the horizontal synchronous signal Hsync and outputs the horizontal start signal STH to the data driving part 740. In addition, the timing controlling part 800 generates the vertical start signal STV using the vertical synchronous signal Vsync and outputs the vertical start signal STV to the gate driving part 130. Furthermore, the timing controlling part 800 generates the first clock signal CLK1 and the second clock signal CLK2 using the clock signal CLK, outputs the first clock signal CLK1 to the gate driving part 130, and outputs the second clock signal CLK2 to the data driving part 740.

The timing controlling part 800 includes the temperature compensating part 900. The temperature compensating part 900 detects and determines the temperature of the display panel 110, and outputs the gate control signal for controlling the gate signal GS. For example, the gate control signal may include the first clock signal CLK1 and the gate voltage control signal GVCS. In addition, the temperature compensating part 900 outputs the gamma data GMA, according to the temperature of the display panel 110, to the gamma voltage generating part 470.

The gamma voltage generating part 470 generates the gamma voltage GMAV according to the gamma data GMA output from the timing controlling part 800, and outputs the gamma voltage GMAV to the data driving part 740.

Figure 15:
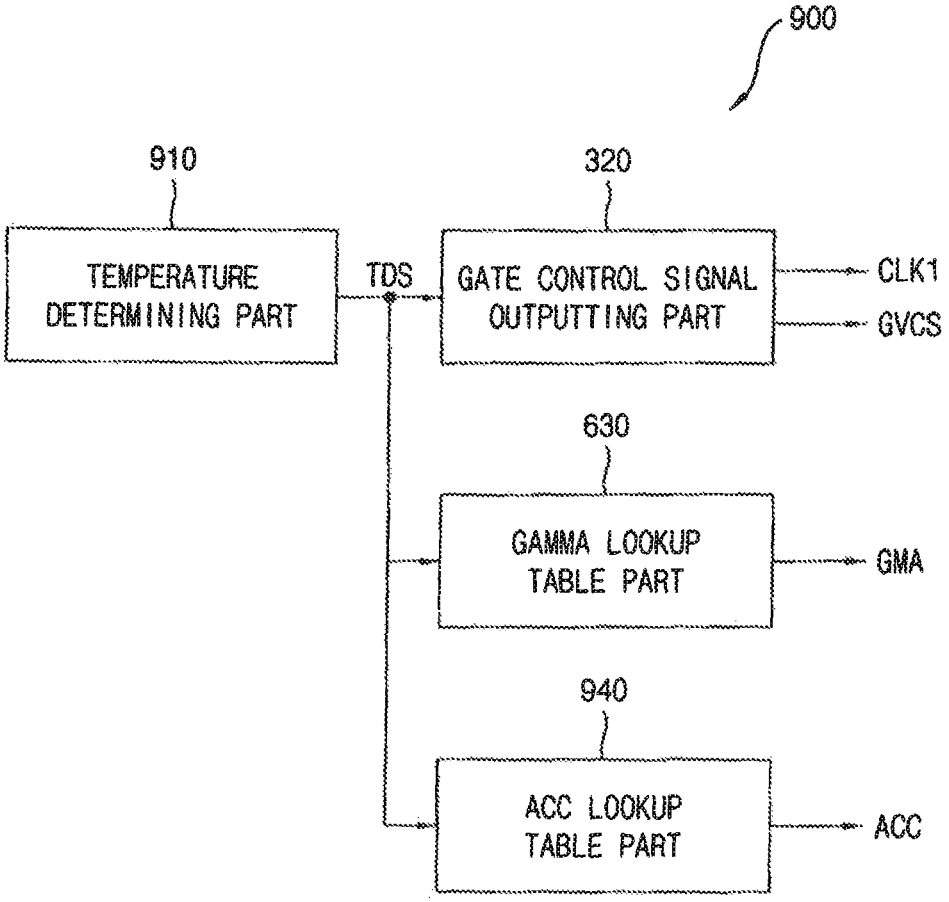
FIG. 15 is a block diagram illustrating a temperature compensating part of FIG. 14 according to an exemplary embodiment of the inventive concept.

FIG. 15 is a block diagram illustrating a temperature compensating part of FIG. 14 according to an exemplary embodiment of the inventive concept.

Referring to FIGS. 14 and 15, the temperature compensating part 900 may include a temperature determining part 910, the gate control signal outputting part 320, the gamma lookup table part 630, and an Accurate Color Capture (ACC) lookup table part 940.

The temperature determining part 910 determines the temperature of the display panel 110, and outputs the temperature determination signal TDS to the gate control signal outputting part 320, the gamma lookup table part 630, and the ACC lookup table part 940. The temperature determining part 910 may be substantially the same as the temperature determining part 310 of FIG. 3.

The gamma lookup table part 630 outputs the gamma data GMA according to the temperature determination signal TDS output from the temperature determining part 910. The gamma lookup table part 630 may include the first gamma lookup table 631, the second gamma lookup table 632, and the third gamma lookup table 633, as illustrated in FIG. 12.

The ACC lookup table part 940 outputs ACC data ACC according to the temperature determination signal TDS output from the temperature determining part 910.

The timing controlling part 800 may perform an ACC process on the first image data DATA1 using the ACC data ACC, and may output the second image data DATA2.

Figure 16:
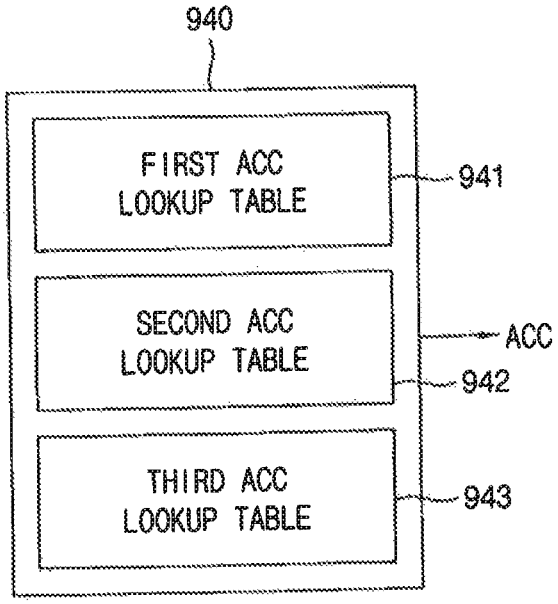
FIG. 16 is a block diagram illustrating an Accurate Color Capture (ACC) lookup table part of FIG. 15 according to an exemplary embodiment of the inventive concept.

FIG. 16 is a block diagram illustrating an ACC lookup table part of FIG. 15 according to an exemplary embodiment of the inventive concept.

Referring to FIGS. 15 and 16, the ACC lookup table part 940 may include a first ACC lookup table 941, a second ACC lookup table 942, and a third ACC lookup table 943. The first ACC lookup table 941, the second ACC lookup table 942, and the third ACC lookup table 943 may store pieces of the ACC data ACC suitable for the temperature ranges of the display panel 110. For example, the first ACC lookup table 941 may store the ACC data ACC suitable for the first temperature range TEP1 illustrated in FIG. 5, the second ACC lookup table 942 may store the ACC data ACC suitable for the second temperature range TEP2 illustrated in FIG. 5, and the third ACC lookup table 943 may store the ACC data ACC suitable for the third temperature range TEP3 illustrated in FIG. 5.

When the temperature of the display panel 110 is in the first temperature range TEP1, the temperature compensating part 900 may output the ACC data ACC from the first ACC lookup table 941. When the temperature of the display panel 110 is in the second temperature range TEP2, the temperature compensating part 900 may output the ACC data ACC from the second ACC lookup table 942. When the temperature of the display panel 110 is in the third temperature range TEP3, the temperature compensating part 900 may output the ACC data ACC from the third ACC lookup table 943.

The ACC lookup table part 940 may further include an ACC lookup table selector for selecting one of the first ACC lookup table 941, the second ACC lookup table 942, and the third ACC lookup table 943 according to the temperature determination signal TDS.

Figure 17:
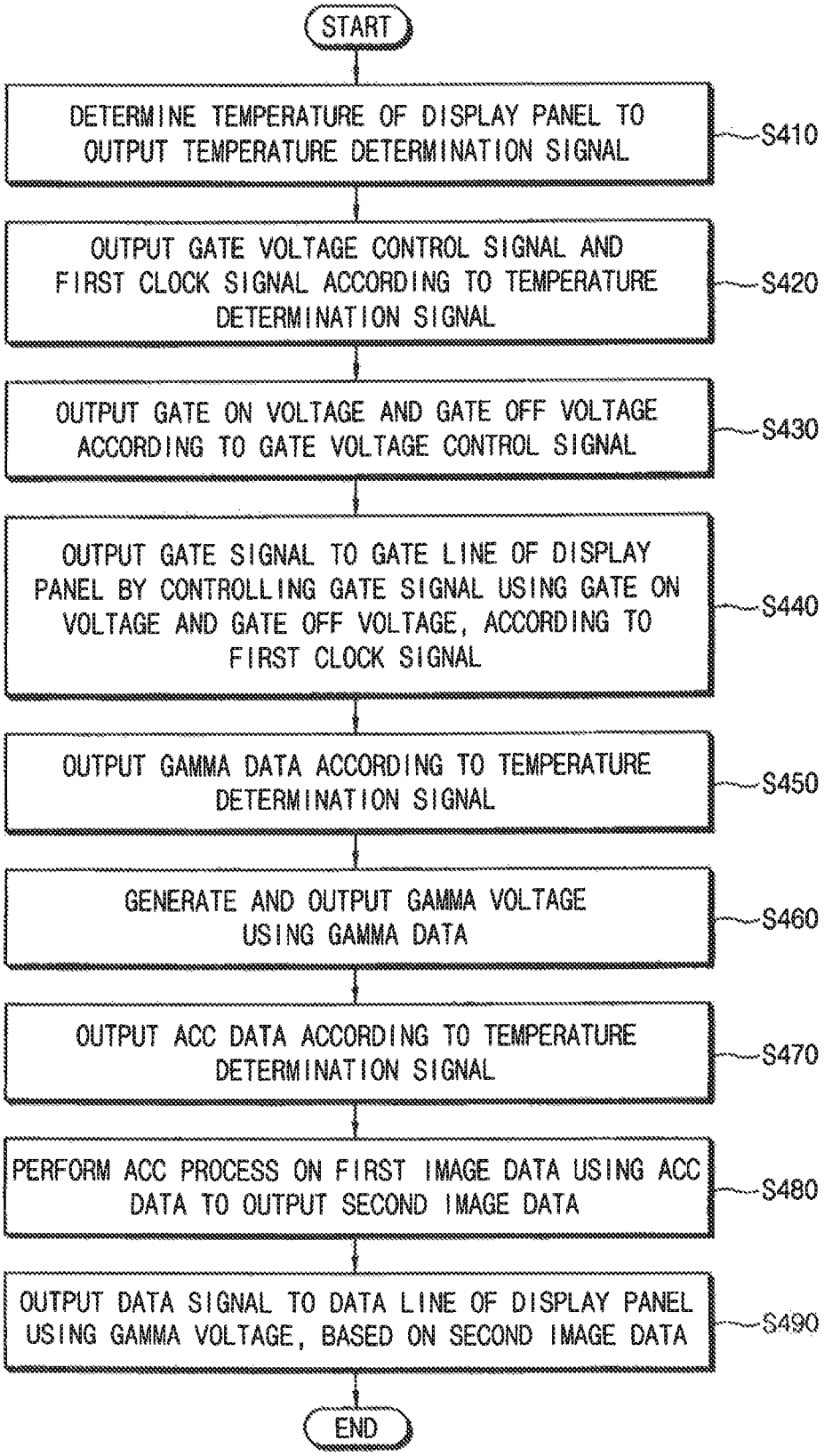
FIG. 17 is flowchart illustrating a method of driving the display apparatus of FIG. 14 according to an exemplary embodiment of the inventive concept.

FIG. 17 is flowchart illustrating a method of driving the display apparatus of FIG. 14 according to an exemplary embodiment of the inventive concept.

Referring to FIGS. 5, 12, and 14 to 17, the temperature of the display panel 110 is determined and the temperature determination signal TDS is output (operation S410). For example, the temperature determining part 910 determines the temperature of the display panel 110 to output the temperature determination signal TDS to the gate control signal outputting part 320, the gamma lookup table part 630, and the ACC lookup table part 940.

The gate voltage control signal GVCS and the first clock signal CLK1 are output according to the temperature determination signal TDS (operation S420). For example, the gate control signal outputting part 320 receives the temperature determination signal TDS from the temperature determining part 910, and outputs the first clock signal CLK1 and the gate voltage control signal GVCS for controlling the gate signal GS according to the temperature of the display panel 110 (e.g., in response to the temperature determination signal TDS).

The gate on voltage Vgon and the gate off voltage Vgoff are output according to the gate voltage control signal GVCS (operation S430). For example, the voltage providing part 160 outputs the gate on voltage Vgon and the gate off voltage Vgoff for controlling the voltage of the gate signal GS according to the gate voltage control signal GVCS output from gate control signal outputting part 320 of the timing controlling part 800.

The gate signal GS is output to the gate lines GL of the display panel 110 by controlling the gate signal GS using the gate on voltage Vgon and the gate off voltage Vgoff, according to the first clock signal CLK1 (operation S440).

The gamma data GMA is output according to the temperature determination signal TDS (operation S450). For example, the gamma lookup table part 630 may include the first gamma lookup table 631, the second gamma lookup table 632, and the third gamma lookup table 633. The first gamma lookup table 631, the second gamma lookup table 632, and the third gamma lookup table 633 may store the pieces of the gamma data GMA suitable for the temperature ranges of the display panel 110. For example, the first gamma lookup table 631 may store the gamma data GMA suitable for the first temperature range TEP1 illustrated in FIG. 5, the second gamma lookup table 632 may store the gamma data GMA suitable for the second temperature range TEP2 illustrated in FIG. 5, and the third gamma lookup table 633 may store the gamma data GMA suitable for the third temperature range TEP3 illustrated in FIG. 5.

When the temperature of the display panel 110 is in the first temperature range TEP1, the temperature compensating part 900 may output the gamma data GMA from the first gamma lookup table 631. When the temperature of the display panel 110 is in the second temperature range TEP2, the temperature compensating part 900 may output the gamma data GMA from the second gamma lookup table 632. When the temperature of the display panel 110 is in the third temperature range TEP3, the temperature compensating part 900 may output the gamma data GMA from the third gamma lookup table 633.

The gamma voltage GMAV is generated and output using the gamma data GMA (operation S460). For example, the gamma voltage generating part 470 generates the gamma voltage GMAV according to the gamma data GMA output from the timing controlling part 800, and outputs the gamma voltage GMAV to the data driving part 740.

The ACC data ACC is output according to the temperature determination signal TDS (operation S470). For example, the ACC lookup table part 940 may include the first ACC lookup table 941, the second ACC lookup table 942, and the third ACC lookup table 943. The first ACC lookup table 941, the second ACC lookup table 942, and the third ACC lookup table 943 may store the pieces of the ACC data ACC suitable for the temperature ranges of the display panel 110. For example, the first ACC lookup table 941 may store the ACC data ACC suitable for the first temperature range TEP1, the second ACC lookup table 942 may store the ACC data ACC suitable for the second temperature range TEP2, and the third ACC lookup table 943 may store the ACC data ACC suitable for the third temperature range TEP3.

When the temperature of the display panel 110 is in the first temperature range TEP1, the temperature compensating part 900 may output the ACC data ACC from the first ACC lookup table 941. When the temperature of the display panel 110 is in the second temperature range TEP2, the temperature compensating part 900 may output the ACC data ACC from the second ACC lookup table 942. When the temperature of the display panel 110 is in the third temperature range TEP3, the temperature compensating part 900 may output the ACC data ACC from the third ACC lookup table 943.

The ACC process is performed on the first image data DATA1 using the ACC data ACC to output the second image data DATA2 (operation S480). For example, the timing controlling part 800 may perform the ACC process on the first image data DATA1 using the ACC data ACC to output the second image data DATA2.

The data signal DS is output to the data lines DL of the display panel 110 using the gamma voltage GMAV, based on the second image data DATA2 (operation S490). For example, the data driving part 740 receives the second image data DATA2 from the timing controlling part 800 and receives the gamma voltage GMAV from the gamma voltage generating part 470. The data driving part 740 generates the data signal DS using the gamma voltage GMAV, based on the second image data DATA2. The data driving part 740 outputs the data signal DS to the data lines DL in response to the horizontal start signal STH and the second clock signal CLK2 provided from the timing controlling part 800.

In the present exemplary embodiment, the ACC lookup table part 940 includes the first ACC lookup table 941, the second ACC lookup table 942, and the third ACC lookup table 943, but the inventive concept is not limited thereto. For example, the ACC lookup table part 940 may include N (where N is a natural number not less than two) ACC lookup tables, corresponding to the number of temperature ranges of the display panel 110.

According to the present exemplary embodiment, since the timing controlling part 800 adaptively performs the ACC process using the ACC data ACC based on the temperature change of the display panel 110, a decrease of display quality of the display apparatus 700 due to the temperature change of the display panel 110 may be prevented.

The present inventive concept may be applied to any electronic device having a display apparatus. For example, the present inventive concept may be applied to a television, a computer monitor, a laptop, a digital camera, a cellular phone, a smart phone, a tablet Personal Computer (PC), a smart pad, a Personal Digital Assistant (PDA), a Portable Multimedia Player (PMP), an MP3 player, a navigation system, a camcorder, a portable game console, etc.

As described above, according to exemplary embodiments of the inventive concept, a data charge rate in which a data voltage is charged to a pixel may be uniformed maintained regardless of a temperature change of a display panel in a display apparatus. Thus, display quality of the display apparatus may be increased.

While the inventive concept has been shown and described with reference to exemplary embodiments thereof, it will be apparent to those of ordinary skill in the art that various substitutions, modifications, and changes may be made thereto without departing from the scope and spirit of the present inventive concept as defined by the following claims.

What is claimed is:

1. A display apparatus comprising:

a display panel configured to display an image and including a gate line and a data line;

a data driving circuit configured to output a data signal to the data line; and a gate driving circuit configured to output a gate signal to the gate line and to control a kick-back time of the gate signal according to a temperature of the display panel, wherein the kick-back time is a time when the gate signal is decreased from a gate on voltage to a kick-back voltage that is between the gate on voltage and a gate off voltage, the kick-back time varies according to the temperature of the display panel, when the temperature of the display panel is in a first temperature range between a first temperature and a second temperature that is higher than the first temperature, the kick-back time is a first kick-back time, and when the temperature of the display panel is in a second temperature range that is higher than the second temperature, the kick-back time is a second kick-back time that is longer than the first kick-back time.

2. The display apparatus of claim 1, wherein the display panel includes a thin film transistor electrically connected to the gate line and the data line, an activation time of the gate signal, during which the gate signal is not less than a threshold voltage of the thin film transistor, is a first activation time when the temperature of the display panel is in the first temperature range, and the activation time of the gate signal is a second activation time that is shorter than the first activation time when the temperature of the display panel is in the second temperature range.

3. The display apparatus of claim 1, wherein when the temperature of the display panel is in a third temperature range that is lower than the first temperature, the kick-back time is a third kick-back time that is shorter than the first kick-back time.

4. The display apparatus of claim 3, wherein the display panel includes a thin film transistor electrically connected to the gate line and the data line, an activation time of the gate signal, during which the gate signal is not less than a threshold voltage of the thin film transistor, is a first activation time when the temperature of the display panel is in the first temperature range, and the activation time of the gate signal is a third activation time that is longer than the first activation time when the temperature of the display panel is in the third temperature range.

5. The display apparatus of claim 1, wherein the display panel includes a thin film transistor electrically connected to the gate line and the data line, an activation time of the gate signal, during which the gate signal is not less than a threshold voltage of the thin film transistor, is a first activation time when the temperature of the display panel is in the first temperature range, and the activation time of the gate signal is a second activation time that is shorter than the first activation time when the temperature of the display panel is in the second temperature range.

6. The display apparatus of claim 1, wherein the display panel includes a thin film transistor electrically connected to the gate line and the data line, an activation time of the gate signal, during which the gate signal is not less than a threshold voltage of the thin film transistor, is a first activation time when the temperature of the display panel is in the first temperature range, and the activation time of the gate signal is a third activation time that is longer than the first activation time when the temperature of the display panel is in a third temperature range that is lower than the first temperature.

7. The display apparatus of claim 1, further comprising:

a temperature determining part configured to determine the temperature of the display panel and output a temperature determination signal.

8. The display apparatus of claim 7, wherein the temperature determining part comprises:

a variable resistor of which a resistance is changed according to the temperature of the display panel;

a first resistor connected to the variable resistor in parallel;

a second resistor connected between the first resistor and a ground voltage terminal; and a current source connected to the variable resistor and the first resistor, and configured to provide a current.

9. The display apparatus of claim 7, further comprising:

a gate control signal outputting part configured to output a gate control signal according to the temperature determination signal.

10. The display apparatus of claim 9, wherein the gate control signal comprises a gate clock signal and a gate voltage control signal, and the gate voltage control signal controls the gate on voltage and the gate off voltage.

11. The display apparatus of claim 1, further comprising:

a plurality of gamma lookup tables corresponding to temperature ranges of the display panel.

12. The display apparatus of claim 1, further comprising:

a plurality of Accurate Color Capture (ACC) lookup tables corresponding to temperature ranges of the display panel.

13. A method of driving a display apparatus, the method comprising:

determining a temperature of a display panel which displays an image;

controlling a kick-back time, according to a temperature of the display panel, to output a gate signal to a gate line of the display panel, wherein the kick-back time is a time when the gate signal is decreased from a gate on voltage to a kick-back voltage that is between the gate on voltage and a gate oft voltage; and outputting a data signal to a data line of the display panel, wherein an activation time of the gate signal, during which the gate signal is not less than a threshold voltage of a thin film transistor electrically connected to the gate line and the data line of the display panel, varies according to the temperature of the display panel.

14. The method of claim 13, wherein when the temperature of the display panel is in a first temperature range between a first temperature and a second temperature that is higher than the first temperature, the kick-back time is a first kick-back time, and when the temperature of the display panel is in a second temperature range that is higher than the second temperature, the kick-back time is a second kick-back time that is longer than the first kick-back time.

15. The method of claim 13, Wherein when the temperature of the display panel is in a first temperature range between a first temperature and a second temperature that is higher than the first temperature, the kick-back time is a first kick-back time, and when the temperature of the display panel is in a second temperature range that is lower than the first temperature, the kick-back time is a second kick-back time that is shorter than the first kick-back time.

16. The method of claim 13, wherein the activation time of the gate signal is a first activation time when the temperature of the display panel is in first temperature range between a first temperature and a second temperature that is higher than the first temperature, and the activation time of the gate signal is a second activation time that is shorter than the first activation time when the temperature of the display panel is in a second temperature range that is higher than the second temperature.

17. The method of claim 13, wherein the activation time of the gate signal is a first activation time when the temperature of the display panel is in a first temperature range between a first temperature and a second temperature that is higher than the first temperature, and the activation time of the gate signal is a second activation time that is longer than the first activation time when the temperature of the display panel is in a second temperature range that is lower than the first temperature.

18. The method of claim 13, further comprising:

outputting Accurate Color Capture (ACC) data by selecting one of a plurality of ACC lookup tables according to the temperature of the display panel; and performing an ACC process on first image data using the ACC data to output second image data.

19. A method of driving a display apparatus including a display panel configured to display an image, the method comprising:

determining a temperature of the display panel;

controlling an activation time of a gate signal to be a first activation time when the temperature of the display panel is in a first temperature range, a second activation time when the temperature of the display panel is in a second temperature range that is greater than the first temperature range, and a third activation time when the temperature of the display panel is in a third temperature range that is less than the first temperature range;

outputting the gate signal to a gate line of the display panel; and outputting a data signal to a data line of the display panel, wherein the activation time of the gate signal is a time when the gate signal is not less than a threshold voltage of a thin film transistor of a pixel included in the display panel, and the second activation time is shorter than the first activation time and the third activation time is longer than the first activation time.

* * * * *